US010825583B2

(12) United States Patent
Hiraoka et al.

(10) Patent No.: US 10,825,583 B2
(45) Date of Patent: Nov. 3, 2020

(54) COAXIAL CABLE

(71) Applicant: Junkosha Inc., Kasama (JP)

(72) Inventors: Daiki Hiraoka, Kasama (JP); Tomohiro Adachi, Kasama (JP); Fumiyuki Furuhashi, Kasama (JP)

(73) Assignee: Junkosha Inc., Kasama (JP)

( * ) Notice: Subject to any disclaimer, the term of this patent is extended or adjusted under 35 U.S.C. 154(b) by 0 days.

(21) Appl. No.: 16/484,905

(22) PCT Filed: Feb. 6, 2018

(86) PCT No.: PCT/JP2018/004095
§ 371 (c)(1),
(2) Date: Feb. 3, 2020

(87) PCT Pub. No.: WO2018/147293
PCT Pub. Date: Aug. 16, 2018

(65) Prior Publication Data

US 2020/0152358 A1 May 14, 2020

(30) Foreign Application Priority Data

Feb. 10, 2017 (JP) ..... 2017-023662

(51) Int. Cl.
*H01B 11/18* (2006.01)

(52) U.S. Cl.
CPC ..... *H01B 11/1813* (2013.01); *H01B 11/1878* (2013.01)

(58) Field of Classification Search
CPC ..... H01B 9/02; H01B 9/023; H01B 9/025; H01B 11/1813; H01B 11/1808; H01B 11/1821; H01B 11/183; H01B 11/1878; H01B 11/18; H01B 13/225; H01B 13/2606; H01B 13/22
See application file for complete search history.

(56) References Cited

U.S. PATENT DOCUMENTS 5,463,188 A 10/1995 Nohmi et al.
2010/0212933 A1* 8/2010 Hayashishita ..... H01B 11/1895 174/113 C

FOREIGN PATENT DOCUMENTS

| | | | |
|---|---|---|---|
| JP | S6350410 U | * | 4/1988 |
| JP | S6350410 U | | 4/1988 |
| JP | H6349345 A | | 12/1994 |
| JP | H9288610 A | | 11/1997 |
| JP | H10334750 A | | 12/1998 |
| JP | 2002358842 A | | 12/2002 |

* cited by examiner

*Primary Examiner* — Timothy J Thompson
*Assistant Examiner* — Amol H Patel
(74) *Attorney, Agent, or Firm* — The Webb Law Firm

(57) ABSTRACT

The present invention relates to a coaxial cable, and particularly to a small-diameter coaxial cable for use in frequency bands of 100 MHz or more. The present invention addresses the problem of providing a coaxial cable which has excellent flexibility, a small outer diameter, and excellent shielding characteristics. The problem is solved by a coaxial cable having an outer conductor which is formed by mixing and laterally winding strands in the same direction, the strands having an outer diameter difference of not less than 10% between a large-diameter strand having a maximum outer diameter and a small-diameter strand having a minimum outer diameter.

3 Claims, 5 Drawing Sheets

COAXIAL CABLE

CROSS-REFERENCE TO RELATED APPLICATIONS

This application is the United States national phase of International Application No. PCT/JP2018/004095 filed Feb. 6, 2018, and claims priority to Japanese Patent Application No. 2017-023662 filed Feb. 10, 2017, the disclosures of which are hereby incorporated by reference in their entirety.

BACKGROUND OF THE INVENTION

1. Field of the Invention

The present invention relates to a coaxial cable, and more particularly, to a coaxial cable having a small diameter, which is used in a band having a frequency of 100 MHz or more, in particular, in a band having a frequency of 1 GHz or more.

2. Description of Related Art

It is known to use a fine coaxial cable for transmitting a high-frequency signal through a fine transmission line, such as a signal line of a medical cable such as an endoscope or an ultrasonic probe cable, or a signal line for controlling a notebook computer, a game machine, or a robot. In recent years, miniaturization of electronic devices has progressed, improvement of handling of cables has been demanded, and a coaxial cable having a smaller diameter and flexibility has been demanded. At the same time, a used frequency band is extended to a high frequency band, and a shielding characteristic for shielding noise in a wide frequency band is required.

In order to improve the shielding characteristics, some conventional outer conductors of coaxial cables use a braided structure. (Patent Document 1) Although the coaxial cable having the outer conductor of the braided structure is excellent in the shielding characteristics, there is a problem that the outer diameter becomes large, friction between the strands constituting the outer conductor is large, flexibility is not sufficient, and productivity is poor. On the other hand, a coaxial cable provided with a lateral winding as an outer conductor of the coaxial cable is excellent in flexibility, but is not sufficient in terms of shielding characteristics for shielding noise.

On the other hand, in order to improve the shielding characteristics while maintaining flexibility, a coaxial cable in which two lateral windings of an outer conductor are provided has been proposed (Patent Document 2). This has a problem in that the winding directions of the lateral windings of the respective layers are different from each other, and the friction between the strands constituting the outer conductor is large like the braided structure, and the flexibility is not sufficient. In addition, since the lateral winding is doubled, the outer diameter is increased correspondingly, and the productivity is also inferior.

Until now, the coaxial cable has not been able to satisfy all of the following items: flexibility of the coaxial cable, superior, stable shielding characteristics and thinner-diameter, and high productivity.

PRIOR ART DOCUMENT

Patent Document 1: Japanese Patent Application Publication No. 1996-102222

Patent Document 2: Japanese Patent Application Publication No. 1994-349345

SUMMARY OF THE INVENTION

The present invention has been made in view of the above-mentioned problems, and an object thereof is to provide a thin coaxial cable which has a small outer diameter, is flexible, can be used in a minute space, and has excellent shielding characteristics.

The above object is solved by a coaxial cable in which an insulator is coated around a center conductor and an outer conductor is provided around the insulator, wherein the outer conductor is formed by mixing and laterally winding strands in the same direction, the strands having an outer diameter difference of not less than 10% between a strand having a maximum outer diameter (large-diameter strand) and a strand having a minimum outer diameter (small-diameter strand).

In the coaxial cable according to the present invention, since the outer conductor is formed by laterally winding strands having outer diameters different from each other by 10% or more by mixing them in the same direction, the strands can be compressed without applying excessive load, gaps are not generated between the strands, leakage of electromagnetic waves and intrusion are suppressed, and excellent shielding characteristics can be obtained. The coaxial cable according to the present invention is superior in shielding characteristics to a conventional coaxial cable having a braided structure of an outer conductor and a double lateral winding structure, and can have an outer diameter smaller than that of a conventional coaxial cable having a braided structure of an outer conductor and a double lateral winding structure.

Furthermore, in the strands constituting the outer conductor of the coaxial cable according to the present invention, it is preferable that the ratio of the outer diameter of the large-diameter strand to the outer diameter of the small-diameter strand is (outer diameter of the large-diameter strand)/(outer diameter of the small-diameter strand)=1.25 to 5.00.

Since the ratio of the outer diameter of the large-diameter strand to the outer diameter of the small-diameter strand in the strands constituting the outer conductor of the coaxial cable according to the present invention is (outer diameter of the large-diameter strand)/(outer diameter of the small-diameter strand)=1.25 to 5.00, it is possible to particularly efficiently compress the strands, and the shielding characteristic is improved. Furthermore, even when the cable is bent, a gap is not generated between the strands, and the load caused by the rubbing of the strands is reduced.

Furthermore, in the outer conductor of the coaxial cable according to the present invention, it is preferable that the lateral winding density represented by the ratio of the conductor shielding area, which is the sum of the shielding areas of the large-diameter strands and the small-diameter strands to the surface area of the lateral winding is (conductor shielding area)/(lateral winding surface area)=1.0 or more.

Since the outer conductor of the coaxial cable according to the present invention is formed by mixing strands having diameters different from each other by 10% or more, it is possible to set the lateral winding density to 1.0 or more by suppressing the influence on the outer diameter and the appearance of the coaxial cable. By setting the lateral winding density to 1.0 or more, a gap is not generated between the strands, and the strands of the outer conductor are compressed to obtain excellent shielding characteristics.

A coaxial cable according to exemplary embodiments of the present inventive concept includes an insulator coated around a center conductor, and an outer conductor provided around the insulator, wherein the outer conductor is formed by mixing and laterally winding strands in the same direction, the strands having an outer diameter difference of not less than 10% between a strand having a maximum outer diameter (large-diameter strand) and a strand having a minimum outer diameter (small-diameter strand).

BRIEF DESCRIPTION OF THE DRAWINGS

The above and other objects, features, and advantages of the present inventive concept will become more apparent to those of ordinary skill in the art by describing exemplary embodiments thereof in detail with reference to the accompanying drawings, in which:

FIG. 3(*b*) is a diagram to explain the compression efficiency of strands of an outer conductor of the coaxial cable of the present invention.

DETAILED DESCRIPTION OF THE INVENTION

Hereinafter, a coaxial cable according to the present invention will be described in detail with reference to the drawings. The embodiments described below are not intended to limit the claimed invention, and not to limit the invention to all combinations of features described in the embodiments.

Figure 1:
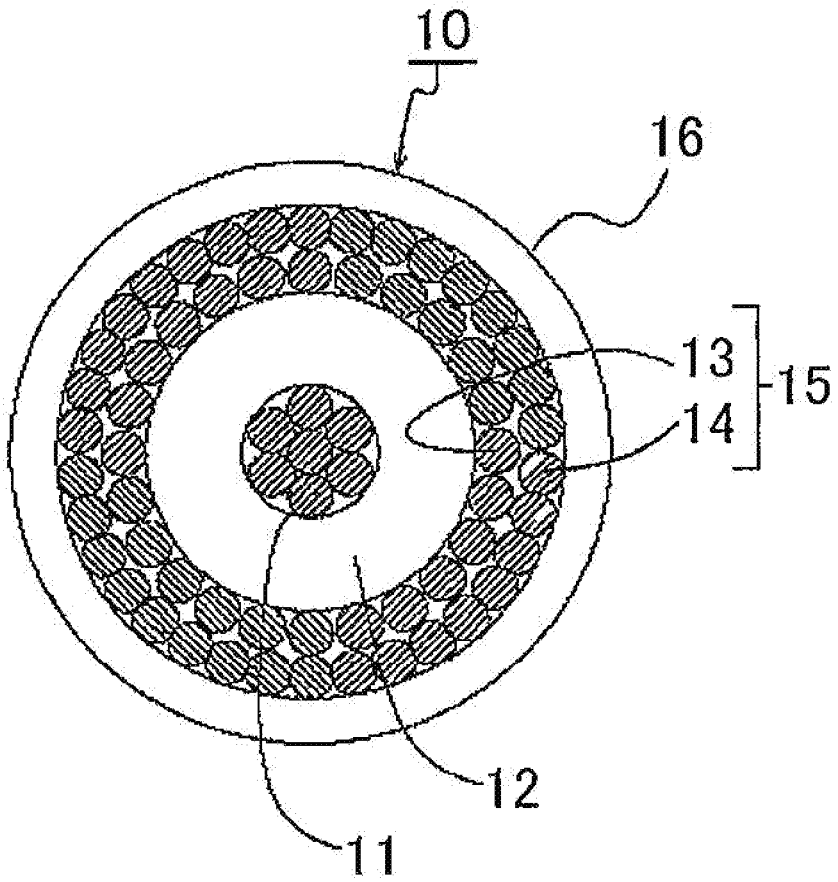
FIG. 1 is an example of a cross-sectional view in the radial direction of a conventional coaxial cable.

FIG. 1 is a cross-sectional view in the radial direction of an example of a conventional coaxial cable, in which an insulating layer 12 is covered on the outer circumference of a center conductor 11, and a first layer of lateral winding 13 and a second layer of lateral winding 14 are superposed on the outer circumference to constitute an outer conductor 15. In the conventional coaxial cable 10, as the strands constituting the outer conductor 15, all of the strands having the same outer diameter are formed in each layer. When the outer conductor 15 is formed of two layers of lateral windings, the outer diameter increases, and when the coaxial cable is bent, the possibility that a gap between the strands of the outer conductor is generated cannot be solved, and flexibility is also reduced.

The inventor of the present invention has found that, unlike the conventional lateral winding, the outer conductor is configured by mixing and laterally winding strands, the strands having an outer diameter difference of 10% or more between a strand having a maximum outer diameter and a strand having a minimum outer diameter, thereby realizing thinning of the wire while having a shielding characteristic superior to that of the conventional coaxial cable.

Figure 2:
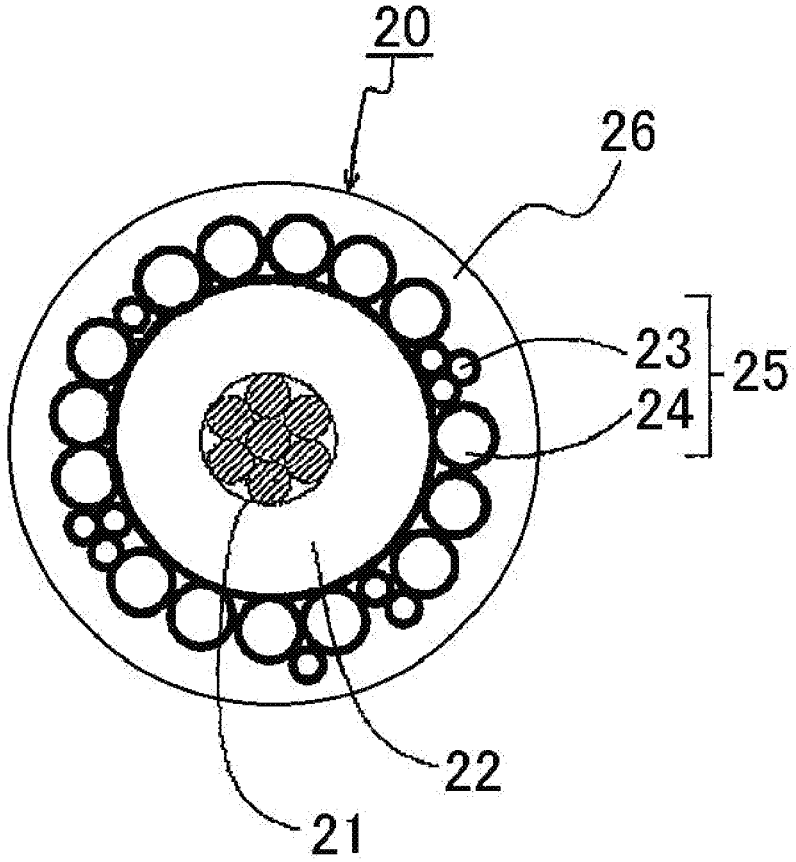
FIG. 2 is an example of a cross-sectional view in the radial direction of a coaxial cable according to an embodiment of the present invention.

The coaxial cable 20 according to the present invention, as shown in FIG. 2, has an insulator 22 around a center conductor 21, and has an outer conductor 25 around the insulator 22. The outer conductor is formed by mixing and laterally winding strands in the same direction, the strands having an outer diameter difference of 10% or more between a strand 24 having a maximum outer diameter (large-diameter strand) and a strand 23 having a minimum outer diameter (small-diameter strand). The outer conductor 25 may have the strands with two or three or more kinds of the outer diameter size.

The center conductor 21 of the coaxial cable 20 according to the present invention includes a plurality of silver-plated copper alloy wires twisted together.

The center conductor 21 may include copper wire or copper alloy wire, such as tin plating, silver plating, nickel plating, or the like, or rough copper, other than copper alloy wire. The twisted wire is used for the center conductor 21 because it is superior in flexibility and is not easily broken as compared with a single-wire, particularly, in the case of using a small-diameter wire, it is preferable to use the twisted wire. A single-wire may be used for the center conductor 21. By using single-wires having the same conductor cross-sectional area, the outer diameter can be reduced as compared with the twisted wire.

A conductor having a small diameter equal to or larger than a diameter of the AWG (American Wire Gauge) 36 is used for the center conductor 21 of the coaxial cable 20 according to the present invention. For example, when a AWG40 silver-plated copper alloy wire is used as the center conductor 21 of the coaxial cable 20, seven silver-plated copper alloy wires having an outer diameter of 0.03 mm are twisted to form the coaxial cable 20 having an outer diameter of 0.09 mm. The effect of the present invention is better in a coaxial cable having a small diameter.

The insulator layer 22 of the coaxial cable 20 according to the present invention is formed of a tetrafluoroethylene-perfluoroalkylvinylether copolymer (PFA). Insulator layers 22 may be formed of polyolefins such as polyethylene or tetrafluoroethylene (PTFE), tetrafluoroethylene-hexafluoropropylene copolymer (FEP), tetrafluoroethylene-ethylene copolymer (ETFE), or the like. The thickness of the insulator layer 22 is determined so as to have a predetermined impedance at the outer diameter of the center conductor 21.

According to the present invention, a mixture of strands having outer diameters different from each other by 10% or more is used in the outer conductor 25 of the coaxial cable 20. A silver-plated soft copper wire is used for a large-diameter strand 24, and a silver-plated hard copper wire is used for a small-diameter strand 23. Strands are wound in the same direction along the outer circumferential surface of the insulating layer 22. For example, 19 silver-plated soft copper wires having an outer diameter of 0.04 mm and 8 silver-plated hard copper wires having an outer diameter of 0.02 mm are mixed and laterally wound in the same direction on the outer circumference of the insulator layer 22 having an outer diameter of 0.24 mm. In addition to the above, the strands of the outer conductor 25 may be formed of copper wires such as tin plating, silver plating, nickel plating, copper alloy wires, rough copper, or the like.

The strands of the outer conductor 25 are preferably formed by laterally wound at an angle of 18° to 40° around the insulator layer 22, and the winding direction is not limited to right-handed or left-handed. For example, the strands are laterally wound at an angle of 25° on the outer circumferential surface of the insulator layer 22, and then the outer conductor 25 is compressed by passing through a die of 0.33 mm. Since the strands having different outer diameters of 10% or more are mixed, to the strands can be efficiently compressed, and the strands are in surface-to-surface contact rather than in line-to-line contact, so that a coaxial cable having excellent shielding characteristics can be obtained.

After the strands of the outer conductor 25 are wound laterally and then passed through a die, the strands are compressed. By compressing the strands, the contact between the strands changes from the line-to-line contact to the surface-to-surface contact, and the gap between the strands becomes smaller. The compressed strands do not open a gap even when the coaxial cable 20 is bent, and a stable shielding effect can be obtained. Compared with an outer conductor of the conventional coaxial cable composed of only strands of the same outer diameter, the compressive force applied from the upper portion of the strands can be efficiently transmitted to the strands, so that the strands can be compressed. If the outer diameters of the large-diameter strands and the small-diameter strands differ by 10% or more, it is effective to suppress a part of the strands from being pushed up from surface of the insulator when the strands are compressed. In particular, when the ratio of the outer diameters of the large-diameter strand to the small-diameter strand is (outer diameter of the large-diameter strand)/(outer diameter of the small-diameter strand)=1.25 to 5.0, the effect of efficiently transmitting the compressive force applied from the outer circumference of the lateral winding between the element wires is high. It is also easy to fit in the gaps of the wires, the efficiency of compression is increased, the outer diameter of the coaxial cable is prevented from increasing, and the shielding effect can be prevented from deteriorating due to the deviation of the strands with respect to the bending of the cable. When the ratio of the outer diameter of the large-diameter strand to the small-diameter strand is larger than 5.0, the strands of the thin wire falls into the gap of the large-diameter strands, and the effect of efficiently transmitting the compressive force becomes small.

Figure 3:
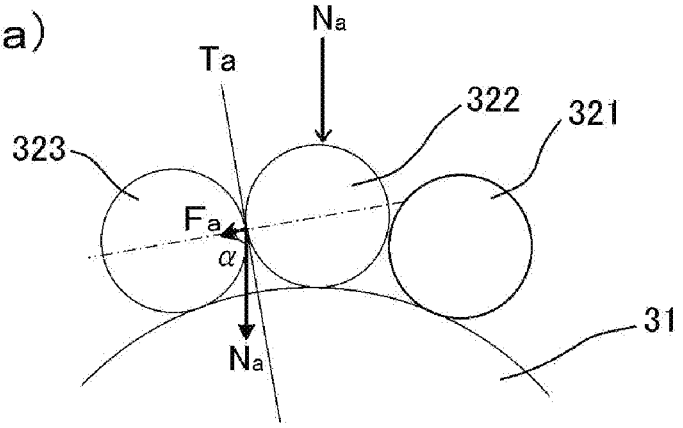
FIG. 3(*a*) is a diagram to explain the compression efficiency of the strands of an outer conductor of the conventional coaxial cable.
Figure 3:
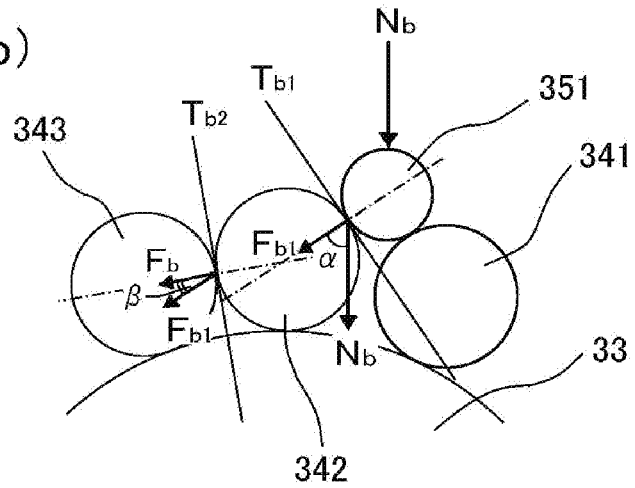

FIG. 3 is a diagram for explaining the compressive force transmitted to the strands when the compressive force is applied to the outer conductor.

FIG. 3(*a*) is a diagram of an outer conductor of a conventional coaxial cable using only strands having the same outer diameter, and FIG. 3(*b*) is a diagram of an outer conductor of a coaxial cable according to the present invention, in which large-diameter strands and small-diameter strands are mixed.

The efficiency (compression efficiency) of the compressive force is transmitted between the strands in (a) and (b) will be described below with reference to FIG. 3.

Compression Efficiency in (a)

When the compressive force $N_a$ is applied on the outer circumference of the large-diameter strands 321, 322, and 323 wound laterally around the outer circumference of the insulator 31, the compressive force $F_a$ acting between the element wires 322 and 323 is obtained. A component of the compressive force $N_a$ in a direction perpendicular to the tangent line $T_a$ between the strand 322 and the strand 323 corresponds to the compressive force $F_a$.

The compressive force Fa is given by the following equation:

$$F_a = N_a \cos \alpha \quad \text{(Equation 1)}$$

Compression Efficiency in (b)

When the compressive force $N_b$ is applied on the outer circumference of the large-diameter strands 341, 342, 343 wound laterally around the outer circumference of the insulator 33 and to the outer circumference of the small-diameter strand 351, the compressive force $F_b$ acting between the strands 342 and 343 is obtained. The compressive force $N_b$ is first applied to the strand 351 located on the outermost circumference of the lateral windings. A component of the compressive force $N_b$ perpendicular to the tangent line $T_{b1}$ between the strands 351 and 342 corresponds to the compressive force $F_{b1}$ applied to the strand 342. A component of the compressive force $F_{b1}$ in directions perpendicular to the tangent line $T_{b2}$ between the strand 342 and the strand 343 corresponds to the compressive force $F_b$ acting on the strand 343.

The compressive force $F_b$ is given by the following equation:

$$F_{b1} = N_b \cos \alpha$$

$$F_b = F_{b1} \cos \beta = N_b \cos \alpha \cos \beta \quad \text{(Equation 2)}$$

The compression efficiency obtained according to the above equation is 11.1 when a strand having an outer diameter of 0.03 mm is used as the outer conductor in the conventional coaxial cable of (a), and 60.8 when a strand having an outer diameter of 0.03 mm and a strand having an outer diameter of 0.021 mm are mixed in the coaxial cable of the present invention of (b). It is understood that the compression efficiency is higher when the strands having different diameters are mixed. It is possible to compress the conductor without applying a large load to the surface of the outer conductor, and even when a fine wire is used, it is possible to process the conductor without causing disconnection of the strand during manufacturing.

Figure 4:
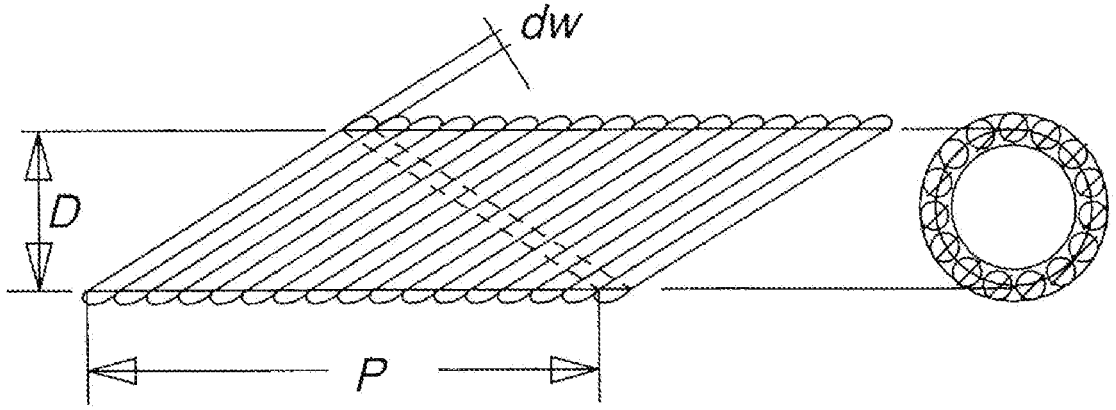
FIG. 4 is a diagram for explaining the lateral winding density.
Figure 5:
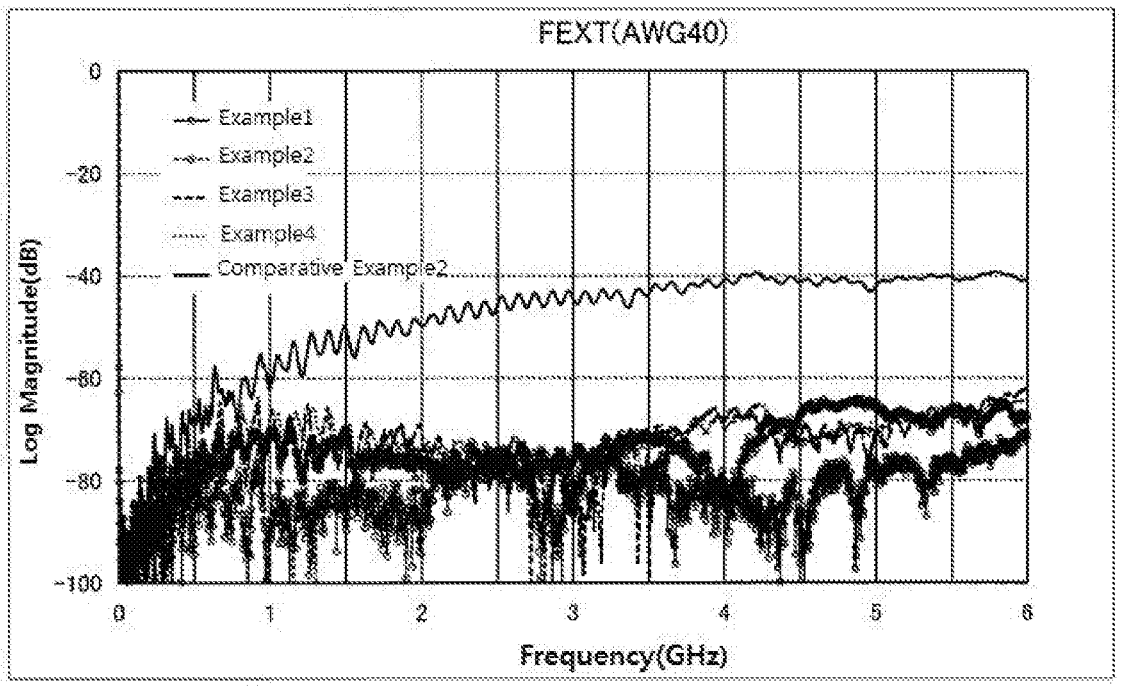
FIG. 5 is a diagram showing the far-end crosstalk characteristics of the electrical characteristics of the multicore transmission cable using the coaxial cable according to the embodiment of the present invention.
Figure 6:
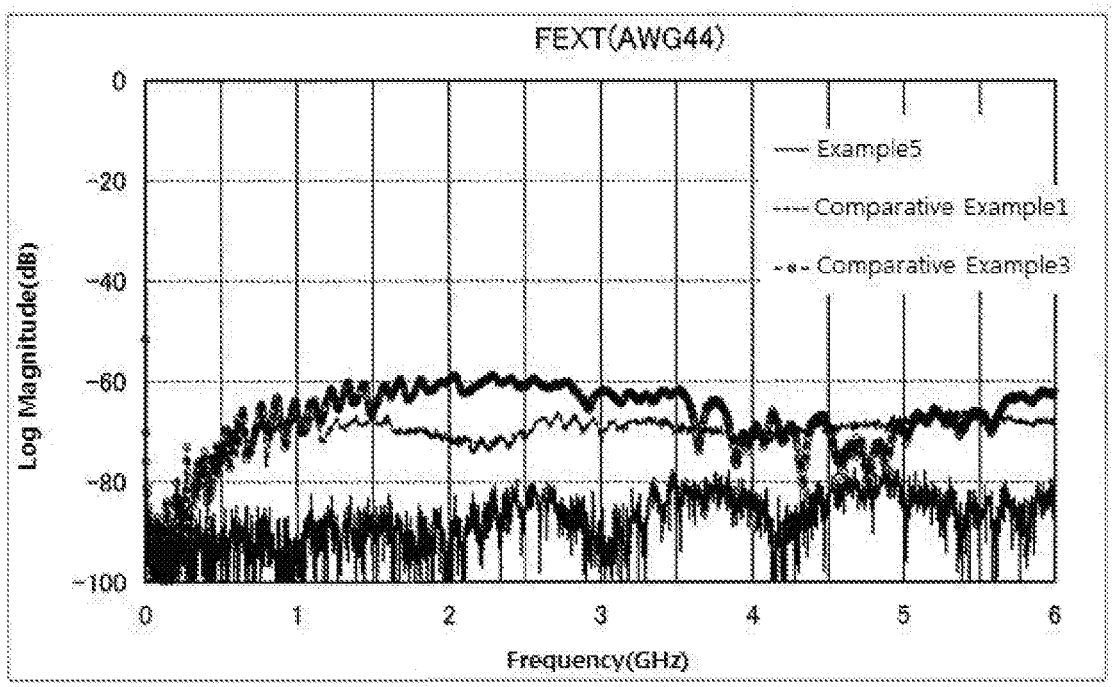
FIG. 6 is a diagram showing the far-end crosstalk characteristics of the electrical characteristics of the multicore transmission cable using the coaxial cable according to the embodiment of the present invention.

According to the present invention, the outer conductor of the coaxial cable can be formed to have a lateral winding density of 1.0 or more, thereby a coaxial cable having excellent shielding characteristics can be obtained. The method of obtaining the lateral winding density will be described with reference to FIG. 4. The lateral winding density is expressed by the ratio of the conductor shielding area to the lateral winding surface area. The symbol D in FIG. 4 indicates the mean diameter of the lateral windings, and can be obtained by the sum of the outer diameter of the insulator and the outer diameter dw of the lateral windings. The lateral winding surface area of a coaxial cable of length P is expressed as P×πD. The conductor shielding area refers to the area covered with the lateral winding strands of the lateral winding surface area, and can be obtained by the following equation, where n is number of lateral winding strands and dw is outer diameter of the lateral winding strands.

$$\text{conductor shielding area} = n \times d_w \sqrt{(\pi D)^2 + P^2} \quad \text{[Mathematical equation 1]}$$

Therefore, the lateral winding density is obtained by the following equation.

$$\text{lateral winding density} = \frac{n \times d_w \sqrt{(\pi D)^2 + P^2}}{P \times \pi D} \quad \text{[Mathematical equation 2]}$$

The outer conductor of the coaxial cable of the present invention has laterally wound strands having different outer diameters. Therefore, the lateral winding density of the outer conductor of the coaxial cable of the present invention is obtained by calculating lateral winding densities for large-diameter strands and small-diameter strands, respectively, and then summing them. The lateral winding density of the outer conductor of the conventional coaxial cable is about 0.95 to 0.98 in consideration of the variation of the outer diameter of the insulator. This is because, if the lateral winding density exceeds 1.0, a part of the outer conductor wire is pushed up to cause problems such as deterioration in appearance and increase in outer diameter. On the other hand, in the outer conductor of the coaxial cable of the present invention, since the strands having different outer diameters by 10% or more, the conductor is hardly pushed up, and even if the lateral winding density is 1.0 or more, the outer diameter is hardly affected.

According to the present invention, the coaxial cable can be provided with a jacket layer of PFA around the outer conductor. The jacket layers may be formed of polyethylene, polyesters, polyimides or tetrafluoroethylene (PTFE), tetrafluoroethylene-hexafluoropropylene copolymer (FEP), tetrafluoroethylene-ethylene copolymer (ETFE), or the like.

According to the present invention, in the coaxial cable, a plurality of coaxial cables can be twisted to form a multi-core cable. A jacket layer is formed on the outer circumference of the plurality of twisted coaxial cables to form a transmission cable.

The invention is explained in more detail in the following examples. The following examples are illustrative of the invention and are not to be construed as limiting the subject matter of the invention by the following examples.

EMBODIMENT

A coaxial cable was prepared so that the characteristic impedances were substantially equal, and the far-end crosstalk was measured by changing the frequency of the transmission signal as a two-core parallel cable in which two cores were arranged in parallel. By suppressing the crosstalk, the shielding characteristic of the coaxial cable can be confirmed.

Example 1

As the center conductor, a AWG40 conductor (a conductor having an outer diameter of 0.09 mm by twisting seven silver-plated copper-alloy strands having an outer diameter of 0.03 mm) was used, and as the insulator layer, PFA was extruded to a thickness of 0.075 mm to obtain an outer diameter of 0.24 mm. The exterior of the insulation layer was rolled horizontally by combining 24 silver-coated soft copper lines having a strand-diameter of 0.03 mm and 8 silver-coated hard copper lines having a strand-diameter of 0.021 mm, and passed through a 0.31 mm die to form an outer conductor. A coaxial cable was produced by extruding 0.03 mm thick PFA onto the outer circumference of the outer conductor. This coaxial cable was used to make a two-core parallel cable, and the far-end crosstalk was measured.

Example 2

A coaxial cable was prepared in the same manner as in Example 1 except that 19 silver-plated soft copper wires having a strand-diameter of 0.04 mm and 8 silver-plated hard copper wires having a strand-diameter of 0.021 mm were mixed and wound laterally as the outer conductor, and a two-core parallel cable was prepared to measure the far-end crosstalk.

Example 3

A coaxial cable was prepared in the same manner as in Example 1 except that 22 silver-plated soft copper wires having a strand-diameter of 0.03 mm, 3 silver-plated hard copper wires having a strand-diameter of 0.021 mm, and 8 silver-plated hard copper wires having a strand-diameter of 0.016 mm were mixed and wound laterally, and a two-core parallel cable was prepared to measure the far-end crosstalk.

Example 4

A coaxial cable was produced in the same manner as in Example 1 except that 13 silver-plated soft copper wires having a strand-diameter of 0.04 mm and 25 silver-plated hard copper wires having a strand-diameter of 0.021 mm were laterally wound as the outer conductor, and a two-core parallel cable was produced to measure the far-end crosstalk.

Example 5

As the center conductor, a AWG44 conductor (a conductor having an outer diameter of 0.06 mm by twisting seven silver-plated copper-alloy wires having an outer diameter of 0.02 mm) was used, and as the insulator layer, PFA was extruded to a thickness of 0.05 mm to obtain an outer diameter of 0.16 mm. Eighteen silver-plated soft copper wires having a strand-diameter of 0.03 mm and five silver-plated hard copper wires having a strand-diameter of 0.016 mm were mixed and wound laterally on the outer circumference of the insulator layer, and passed through a die having a diameter of 0.23 mm to form an outer conductor. A coaxial cable was produced by extruding 0.03 mm thick PFA onto the outer circumference of the outer conductor. This coaxial cable was used to make a two-core parallel cable, and the far-end crosstalk was measured.

Example 6

As the center conductor, a AWG48 conductor (a conductor having an outer diameter of 0.038 mm by twisting seven silver-plated copper-alloy wires having an outer diameter of 0.013 mm) was used, and as the insulator layer, PFA was extruded to a thickness of 0.026 mm to obtain an outer diameter of 0.09 mm Sixteen silver-plated hard copper wires having a strand-diameter of 0.021 mm and four silver-plated hard copper wires having a strand-diameter of 0.016 mm were mixed and wound laterally on the outer circumference of the insulator layer, and passed through a die having a diameter of 0.15 mm to form an outer conductor. A coaxial cable was produced by extruding 0.025 mm thick PFA onto the outer circumference of the outer conductor. This coaxial cable was used to make a two-core parallel cable, and the far-end crosstalk was measured.

Comparative Example 1

A conductor having an outer diameter of 0.06 mm by twisting seven silver-plated copper alloy wires having an outer diameter of 0.02 mm was used as a center conductor, and PFA was extruded as an insulator layer to a thickness of 0.05 mm to obtain an outer diameter of 0.16 mm. Eighteen silver-plated soft copper wires having a strand-diameter of 0.03 mm were wound laterally around the outer circumference of the insulator layer, and 24 silver-plated soft copper wires having a strand-diameter of 0.03 mm were wound laterally around the outer circumference in the same direction to form an outer conductor. A coaxial cable was produced by extruding 0.025 mm thick PFA onto the outer circumference of the outer conductor. This coaxial cable was used to make a two-core parallel cable, and the far-end crosstalk was measured.

Comparative Example 2

A coaxial cable was prepared in the same manner as in Example 1 except that 11 silver-plated soft copper wires having a strand-diameter of 0.04 mm and 22 silver-plated soft copper wires having a strand-diameter of 0.021 mm were mixed and wound laterally as the outer conductor, and a two-core parallel cable was prepared to measure the far-end crosstalk.

Comparative Example 3

A coaxial cable was produced in the same manner as in Comparative Example 1 except that 12 silver-plated soft copper wires having a strand-diameter of 0.03 mm and 12 silver-plated hard copper wires having a strand-diameter of 0.016 mm were laterally wound as the outer conductor, and a two-core parallel cable was produced to measure the far-end crosstalk.

The examples and comparative examples are shown in Table 1.

The far-end crosstalk of each example and each comparative example was measured by a vector network analyzer (VNA).

FIG. 7 is a graph showing the far-end crosstalk characteristics among the electric characteristics of the coaxial cables of the embodiment and the comparative example in which the AWG40 conductor is the center conductor, and the horizontal axis shows the frequencies of the transmission signals and the vertical axis shows the gains. FIG. 8 is a diagram showing the same far-end crosstalk characteristics of the coaxial cables of the embodiment and the comparative example in which the conductor equal to or larger than the AWG44 is used as the center conductor. As shown in Table 1, FIG. 7, and FIG. 8, in the examples, compared with the conventional coaxial cable shown in the comparative example, the outer diameter of the outer conductor was finer than that of the conventional coaxial cable, and it was confirmed that the crosstalk for each frequency was sufficiently suppressed and the shielding characteristics were excellent compared with the conventional coaxial cable, whereas the coaxial cable of the comparative example was not compatible with the shielding characteristics and the reduction in diameter.

INDUSTRIAL APPLICABILITY

The thin coaxial cable of the present invention can be applied to a medical cable, a notebook computer, a game machine, a robot control signal cable signal transmission cable, and the like.

| | | Example 1 | Example 2 | Example 3 | Example 4 | Example 5 | Example 6 | Comparative example 1 | Comparative example 2 | Comparative example 3 |
|---|---|---|---|---|---|---|---|---|---|---|
| Center Conductor | #/mm | 7/0.03 | 7/0.03 | 7/0.03 | 7/0.03 | 7/0.02 | 7/0.013 | 7/0.02 | 7/0.03 | 7/0.02 |
| Outer Diameter of Insulator | mm | 0.24 | 0.24 | 0.24 | 0.24 | 0.16 | 0.038 | 0.16 | 0.24 | 0.16 |
| Final Outer Diameter of Outer Conductor | mm | 0.30 | 0.32 | 0.30 | 0.33 | 0.22 | 0.15 | 0.28 | 0.30 | 0.22 |
| Outer Conductor Large-diameter Strand | #/mm | 24/0.03 | 19/0.04 | 22/0.03 | 13/0.04 | 18/0.03 | 16/0.021 | 18/0.03 | 26/0.03 | 12/0.03 |
| Small-diameter Strand 1 | #/mm | 8/0.021 | 8/0.021 | 8/0.016 | 25/0.021 | 5/0.016 | 4/0.016 | 24/0.03 | | 12/0.016 |
| Small-diameter Strand 2 | #/mm | | | 3/0.021 | | | | | | |
| Diameter ratio of large-diameter to small-diameter | | 1.4 | 1.9 | 1.9 | 1.9 | 1.9 | 1.3 | 1.0 | — | 1.9 |
| Lateral winding density % | | 106.1% (85.5 + 20.6) | 107.7% (87.1 + 20.6) | 102.1% (78.4 + 16.5) | 124.1% (59.6 + 64.5) | 105.7% (14.6 + 91.1) | 112.3% (93.7 + 18.6) | — | 92.6% (92.6) | 95.6% (60.7 + 34.9) |
| Strand material Large-diameter/small-diameter | | SAT/SHS | SAT/SHS | SAT/SHS/SHS | SAT/SHS | SAT/SHS | SHS/SHS | SAT/SAT | SAT | SHS |

DESCRIPTION OF REFERENCE NUMERALS

10: Conventional coaxial cable

20: Coaxial cable of the present invention

What is claimed is:

1. A coaxial cable, comprising:

an insulator coated around a center conductor; and an outer conductor provided around the insulator, wherein the outer conductor is formed by mixing and laterally winding strands in the same direction, the strands having an outer diameter difference of not less than 10% between a strand having a maximum outer diameter (large-diameter strand) and a strand having a minimum outer diameter (small-diameter strand), wherein a lateral winding density (conductor shielding area)/(lateral winding surface area) is 1.0 or more, and wherein the lateral winding density is represented by the ratio of the conductor shielding area, which is a sum of shielding area of large-diameter strands and strands other than the large-diameter strands, to the lateral winding surface area.

2. The coaxial cable of claim 1, wherein the ratio of an outer diameter of the large-diameter strand to an outer diameter of the small-diameter strand is (outer diameter of large-diameter strand)/(outer diameter of small-diameter strand)=1.25 to 5.00.

3. The coaxial cable of any of claims 1 to 2, wherein the center conductor has AWG (American Wire Gauge) value of 36 or more.

* * * * *